US008192178B2

(12) United States Patent
Nishii et al.

(10) Patent No.: US 8,192,178 B2
(45) Date of Patent: Jun. 5, 2012

(54) INVERTER-DEVICE BUILT-IN TYPE ELECTRIC COMPRESSOR AND VEHICLE EQUIPPED WITH THE SAME COMPRESSOR

(75) Inventors: Nobuyuki Nishii, Shiga (JP); Naomi Gotou, Shiga (JP)

(73) Assignee: Panasonic Corporation, Osaka (JP)

( * ) Notice: Subject to any disclaimer, the term of this patent is extended or adjusted under 35 U.S.C. 154(b) by 191 days.

(21) Appl. No.: 12/565,950

(22) Filed: Sep. 24, 2009

(65) Prior Publication Data

US 2010/0077793 A1 Apr. 1, 2010

(30) Foreign Application Priority Data

Sep. 29, 2008 (JP) ..... 2008-250143
Apr. 23, 2009 (JP) ..... 2009-104981

(51) Int. Cl.
*F04B 17/00* (2006.01)
*F04B 35/04* (2006.01)

(52) U.S. Cl. ..... 417/410.5; 417/410.3

(58) Field of Classification Search ..... 417/410.1, 417/410.3, 410.5, 422
See application file for complete search history.

(56) References Cited

U.S. PATENT DOCUMENTS 6,321,563 B1 * 11/2001 Ikeda et al. ..... 62/505
6,564,576 B2 * 5/2003 Shibuya ..... 62/505
6,599,104 B2 * 7/2003 Saito et al. ..... 417/366
6,619,933 B2 * 9/2003 Ikeda ..... 417/410.1
6,808,372 B2 * 10/2004 Makino et al. ..... 417/410.5
7,147,443 B2 * 12/2006 Ogawa et al. ..... 417/410.1
7,179,068 B2 * 2/2007 Makino et al. ..... 418/55.4
7,207,187 B2 * 4/2007 Funahashi et al. ..... 62/228.4
7,473,079 B2 * 1/2009 Ogawa et al. ..... 417/410.5
2002/0146335 A1 10/2002 Koyama et al.
2003/0002998 A1 1/2003 Makino et al.
2004/0109772 A1 6/2004 Ogawa et al.

FOREIGN PATENT DOCUMENTS

JP 2004-183631 7/2004
JP 2006-002755 1/2006

OTHER PUBLICATIONS

European Search Report issued Jul. 13, 2011 in EP 09 17 0453, which is a foreign counterpart to the present application.

* cited by examiner

*Primary Examiner* — Peter J Bertheaud
(74) *Attorney, Agent, or Firm* — Wenderoth, Lind & Ponack, L.L.P.

(57) ABSTRACT

An inverter-device built-in type electric compressor includes a compressor terminal and a direct-mounting connector, which connects the inverter-device to an external circuit, at an electric compressor side. The direct-mounting connector faces toward the electric compressor and is placed in parallel with a center axis of the electric compressor. A harness connector wired from a motor of the electric compressor is detachably and electrically connected to the compressor terminal, and the electric compressor is detachably and mechanically connected to the inverter-device.

5 Claims, 7 Drawing Sheets

FIG. 9 – PRIOR ART
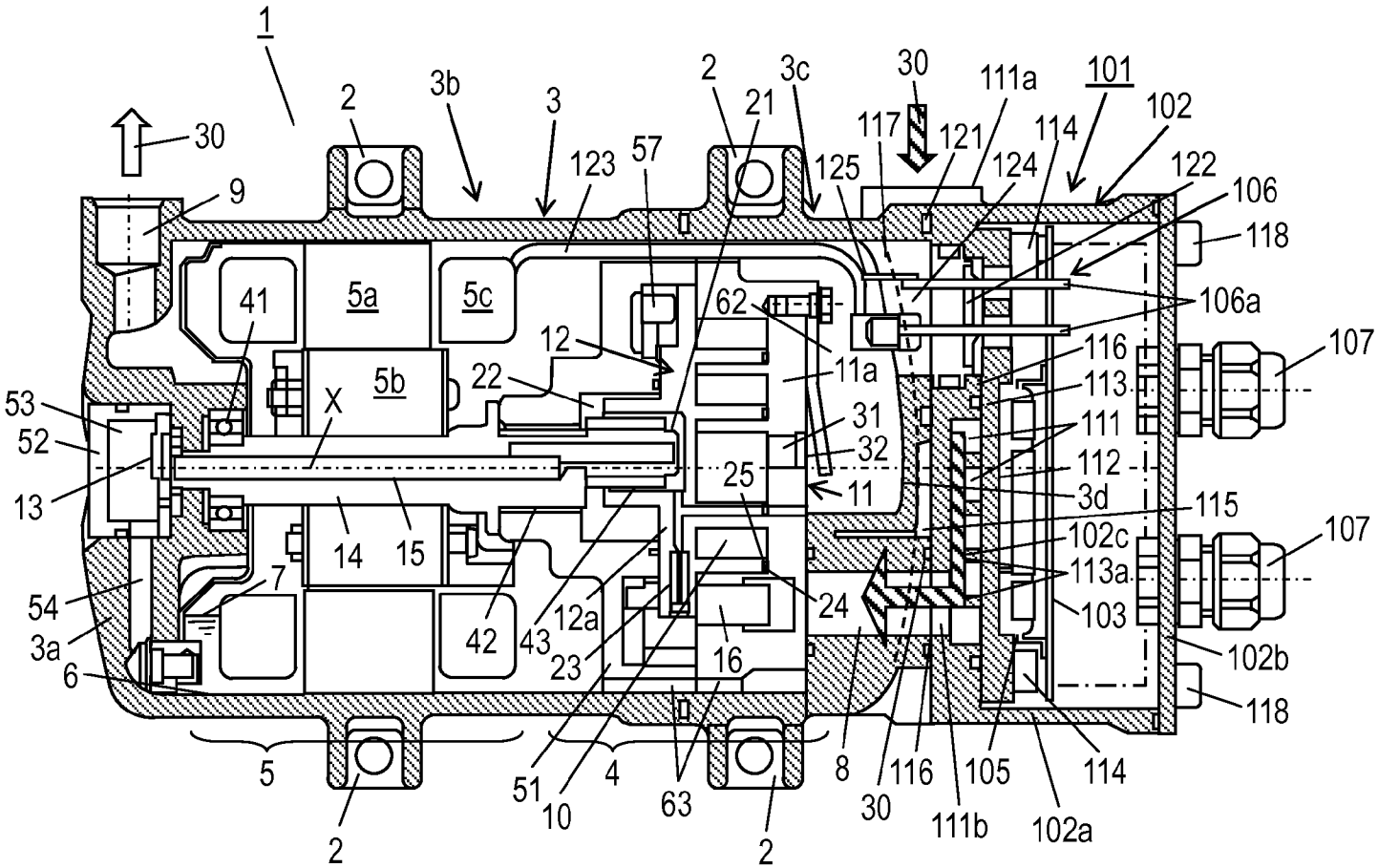

FIG. 10 – PRIOR ART
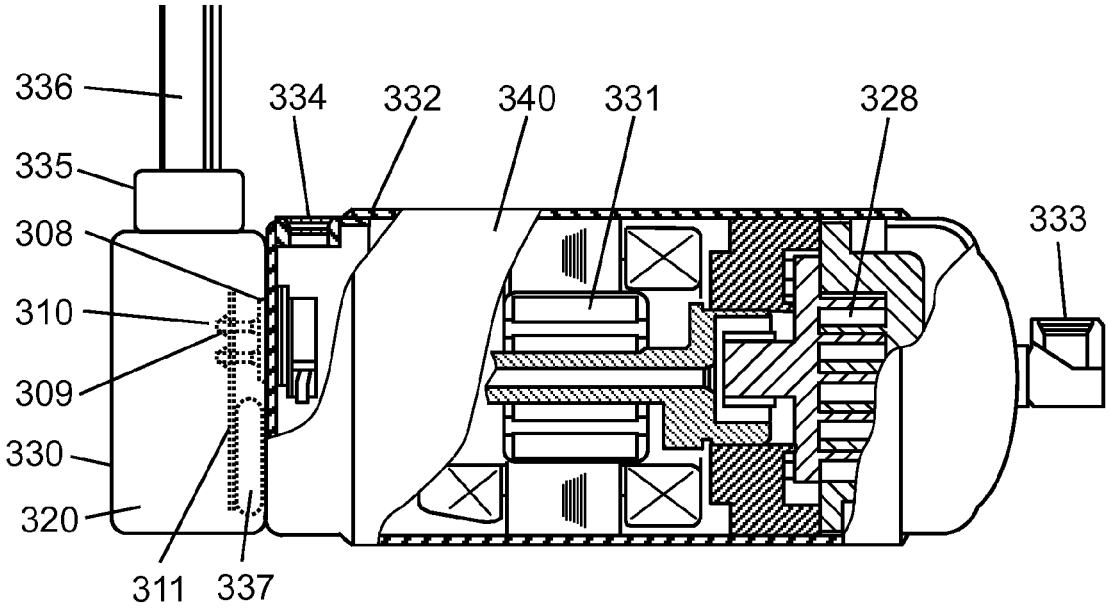

INVERTER-DEVICE BUILT-IN TYPE ELECTRIC COMPRESSOR AND VEHICLE EQUIPPED WITH THE SAME COMPRESSOR

FIELD OF THE INVENTION

The present invention relates to an electric compressor for sucking, compressing, and discharging refrigerant, where the compressor is built-in with an inverter-device for driving a motor of the compressor, and it also relates to a vehicle equipped with the same compressor.

BACKGROUND OF THE INVENTION

An inverter-device built-in type electric compressor is disclosed, e.g. in FIG. 1 of Unexamined Japanese Patent Application Publication No. 2004-183631. FIG. 1 of this document depicts an inverter-device mounted to an electric compressor along the center axis of the compressor.

Present FIG. 9 shows an example of a conventional inverter-device built-in type electric compressor. As shown in FIG. 9, container 3 accommodates compressing mechanism 4, motor 5 and other components for forming the electric compressor. Inverter housing 102 accommodates compressor terminal 106, circuit board 103 and other components for forming the inverter-device. Harness connector 107 is disposed on lid 102*b* for electrically connecting with an external device or circuit. Compressor terminal 106 is disposed for connecting with motor 5. The inverter-device is cooled by refrigerant 30 sucked in. (The reference signs used in the foregoing description are quoted from Unexamined Japanese Patent Application Publication No. 2004-183631.)

Another inverter-device built-in type electric compressor is disclosed in FIG. 1 of Unexamined Japanese Patent Application Publication No. 2006-2755. This conventional instance includes a compressor terminal placed at an electric compressor side, and an inverter-device mounted along the center axis of the electric compressor.

Present FIG. 10 shows a second example of the conventional inverter-device built-in type electric compressor. As shown in FIG. 10, inverter-device 320 is mounted closely to electric compressor 340 so that inverter-device 320 can be cooled by the refrigerant of compressor 340. Terminals of compressor terminal 308 are directly soldered to printed circuit board 311 to achieve an electrical connection. Lead wires (harness) 336 are directed upward from inverter-device 320 to electrically connect with an external circuit.

The conventional example shown in FIG. 9 includes the inverter-device mounted along the center axis of the electric compressor, of which length along the center axis is thus obliged to be long. On top of that, harness connector 107 is disposed along the center axis, so that the length of the electric compressor is thus obliged to be even longer. Compressor terminal 106 and harness connector 107 are respectively disposed on opposite faces of housing 102 such that they are directed in opposite directions to each other. This structure lowers the work efficiency during the assembly and the inspection of the inverter-device because it is difficult to assemble the components or inspect them along one direction at the same time.

The conventional example shown in FIG. 10 includes lead-wires (harness) 336 directed upward and crossing the center axis of the compressor at right angles, so that the electric compressor does not need a long length along the center axis. However, inverter-device 320 is electrically connected with compressor 340 by soldering, so that compressor 340 must be brought into an assembly site or an inspection site of inverter-device 320. As a result, inverter-device 320 that is an electric device and compressor 340 that is a mechanical-device cannot be assembled or inspected independently and appropriately in an electric-device factory and a mechanical-device factory respectively. Inverter-device 320 and compressor 340 always come together, so that the work efficiency is lowered.

What is even worse, in the case of malfunction, it is difficult to identify which part of the inverter-device built-in type electric compressor is defective, namely, it is difficult for a user to ascertain whether the inverter-device is defective or the electric compressor is defective.

SUMMARY OF THE INVENTION

The present invention addresses the problems discussed above, and aims to provide an inverter-device built-in type electric compressor which has the following two advantages: (1) It does not need such long length along the center axis; and (2) Work efficiency during the assembly and inspection of the compressor can be improved.

The inverter-device built-in type electric compressor of the present invention comprises the following structural elements:

- an electric compressor formed of a compressor mechanism and a motor for driving the compressor mechanism;
- an inverter-device, which is mounted to the electric compressor along a center axis of the electric compressor and operates the motor;
- a compressor terminal provided to the inverter-device at the electric compressor side for electrically connecting the inverter-device to the electric compressor; and
- a direct-mounting connector directly mounted to the inverter-device at the electric compressor side for electrically connecting the inverter-device to an external circuit.

The direct mounting connector is directed toward the electric compressor and is placed in parallel with the center axis of the electric compressor. A harness connector mounted to the motor is detachably and electrically connected to the compressor terminal. The electric compressor mechanically and detachably connects with the inverter-device.

The foregoing structure allows the direct mounting connector, which is used for connecting the inverter-device to an external circuit, to be directed toward the electric compressor, so that the length along the center axis can be restricted within a certain length.

The compressor terminal and the direct mounting connector can be mounted to the inverter-device at the electric compressor side, namely, they can be placed on the same side. As a result, an assembly or an inspection of these elements can be done simultaneously on the one face along the one direction, so that the work efficiency of the assembly or the inspection can be improved.

The electric compressor and the inverter-device are connected together detachably both in an electrical manner and a mechanical manner, namely, they can be separated detachably, so that a degree of freedom about an assembly site or an inspection site can be improved, and the work efficiency of the assembly or the inspection can also be improved.

The inverter-device built-in type electric compressor of the present invention can thus restrict the length along the center axis of the electric compressor, and can improve the work efficiency of the assembly and inspection.

BRIEF DESCRIPTION OF THE DRAWINGS

FIG. 9 shows a first example of conventional inverter-device built-in type electric compressors.

FIG. 10 shows a second example of the conventional inverter-device built-in type electric compressors.

PREFERRED EMBODIMENTS OF THE INVENTION

Figure 1A:
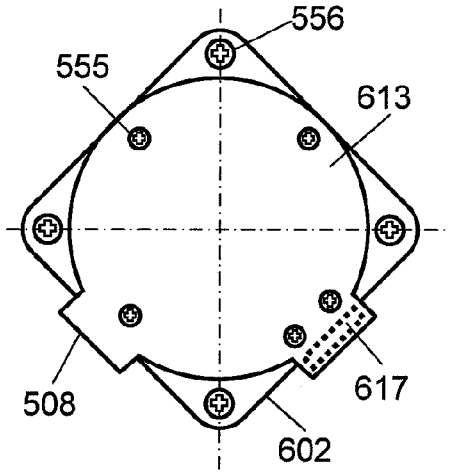
FIG. 1A shows a lateral view of an inverter-device built-in type electric compressor in accordance with a first embodiment of the present invention.

Exemplary embodiments of the present invention are demonstrated hereinafter with reference to the accompanying drawings. Dimensions of respective structural elements are enlarged to facilitate description, and similar elements in the drawings have the same reference signs and the descriptions thereof are sometimes omitted. The invention cannot be limited with these embodiments.

Exemplary Embodiment 1

Figure 1B:
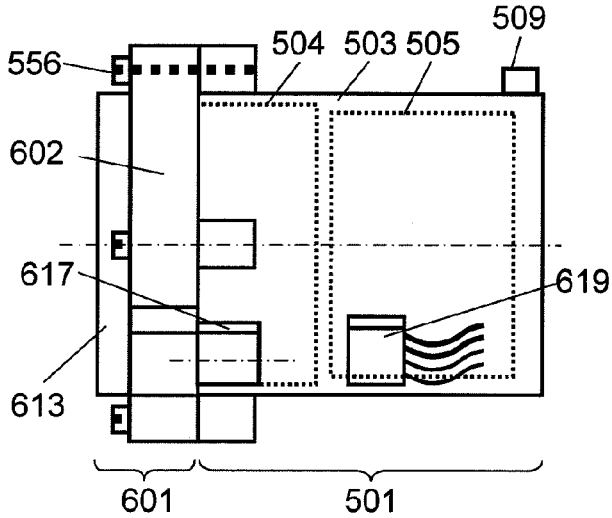
FIG. 1B shows a front view of the inverter-device built-in type electric compressor in accordance with the first embodiment of the present invention.

FIG. 1A shows a lateral view of an inverter-device built-in type electric compressor in accordance with the first embodiment of the present invention. FIG. 1B shows a front view of the inverter-device built-in type electric compressor in accordance with the first embodiment of the present invention. As shown in FIGS. 1A and 1B, the inverter-device built-in type electric compressor lies on its side with mounting brackets (not shown) disposed around the trunk of the electric compressor 501. Container 503 accommodates motor 505 and compressing mechanism 504, whereby compressor 501 is formed. Motor 505 is driven by inverter-device 601, and compressing mechanism 504 is driven by motor 505. Compressing mechanism 504 sucks low-pressured refrigerant from a refrigerating cycle through suction port 508 placed at inverter housing 602, and compresses the refrigerant, and then discharges the refrigerant. The refrigerant discharged is supplied to motor 505 for cooling motor 505, and then is discharged from discharge port 509 disposed at container 503 to the refrigerating cycle. Compressor 501 is thus a high-pressure type compressor.

Inverter housing 602 is screwed down to container 503 with bolts 556, and inverter cover 613 is screwed down to inverter housing 602 with screws 555. Inverter-device 601 includes direct-mounting connector 617 directly mounted thereto for electrically connecting inverter-device 601 to an external circuit.

When the inverter-device built-in type electric compressor in accordance with the first embodiment is mounted to an air-conditioner, direct mounting connector 617 is mounted horizontally to inverter-device 601 as shown in FIGS. 1A and 1B. Connector 617 is placed along the surface of compressor 501 such that the center axis of connector 617 runs horizontally along the center axis of compressor 501, namely, both of the center axes run in parallel. Connector 619 coming from the outside is electrically connected to inverter-device 601 via connector 617. This structure allows for restricting of the length along the center axis of the inverter-device built-in type electric compressor because direct mounting connector 617 faces toward compressor 501. If direct mounting connector 617 is placed at the opposite side to compressor 501, the longitudinal length of the inverter-device built-in type electric compressor is obliged to be longer, which is a disadvantage to the built-in type electric compressor to be mounted to the air-conditioner.

When connector 619 is detached from connector 617 in the horizontal type inverter-device built-in electric compressor discussed above, foreign matter, e.g. water or dust, scarcely enters connector 617 from the top, so that reliability of electrical connection can be improved.

If direct mounting connector 617 faces upward along the vertical direction, foreign matter can enter connector 617 from the top when connector 619 is detached from connector 617. Since inverter-device 601 includes some heat-generating components, the temperature temporarily rises. While the temperature lowers, moisture can be absorbed through an opening of connector 617 because of respiration by the members of components.

If direct-mounting connector 617 faces downward along the vertical direction, foreign matter cannot enter connector 617; however, since compressor 501 is typically mounted at a low place, it is difficult to find enough space for the work particularly in the case of the horizontal type inverter-device built-in electric compressor. The downward-facing connector makes it difficult to be connected or detached because of the limited space. The workability of connector 617 is thus lowered.

In the case of the horizontal type inverter-device built-in electric compressor, the center axis of direct-mounting connector 617 is placed lower than the center axis of compressor 501. This structure allows a greater part of connector 617 to be placed lower than the center axis of compressor 501, and also prevents foreign matter from entering connector 617 from the top. On top of that, this structure allows for narrowing of the width, viewed from the top, of the inverter-device built-in type electric compressor, so that this built-in type compressor advantageously requires a smaller space when it is mounted into an air-conditioner.

Figure 2:
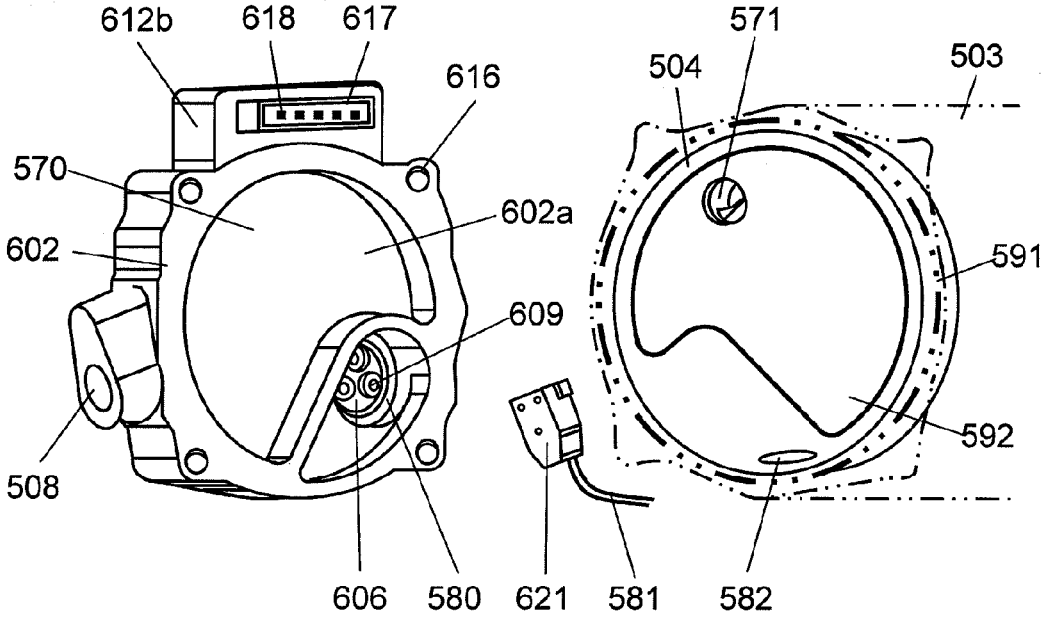
FIG. 2 shows an exploded perspective view of a structure covering a space of a cooling path of the inverter-device in accordance with the first embodiment of the present invention.

FIG. 2 shows an exploded perspective view of a structure covering space 570 of a cooling path of the inverter-device in accordance with the first embodiment. Cooling path space 570 is formed by being covered with inverter housing 602 and compressing mechanism 504. Inverter housing 602 and compressor mechanism 504 are combined air-tightly with O-ring 592, so that a suction path communicating with suction port 508 is formed.

The refrigerant sucked through suction port 508 and provided to inverter housing 602 diffuses in cooling-path space 570 and cools end wall 602*a* of housing 602, thereby cooling heating elements such as a switching module (not shown) mounted behind end wall 602*a*. The refrigerant then flows into the compressing space via path hole 571 of compressing mechanism 504.

Compressor terminal 606 is rigidly mounted to inverter housing 602 with retaining ring 580. Direct-mounting connector 617 is directly mounted to inverter housing 602 at end section 612*b*. FIG. 2 shows terminals 618 of connector 617. Two of the terminals 618 work for power supply, and another two of the terminals 618 work for communication. The connecting part of compressor terminal 606 and that of connector 617 thus face toward compressor 501, namely, their connecting parts are placed at the same side, so that electrical to connecting work can be done along one direction. As a result, the work efficiencies of assembly and inspection can be improved.

Lead wire 581 wired from motor 505 connects with harness connector 621 through communicating path 582 provided around compressing mechanism 504, and then electrically connects with terminal 609 of compressor terminal 606. Inverter housing 602 is mechanically connected to container 503 in an air-tight manner by bolts 556 extending through bolt holes 616 with O-ring 591 sandwiched between container 503 and housing 602. Cooling-path space 570 is kept at a low pressure within O-ring 592 while it is kept at a high pressure from O-ring 591 to O-ring 592. Use of harness connector 621 for the foregoing electrical connection and use of bolts 556 for the foregoing mechanical connection allow compressor 501 and inverter-device 601 to be detachable. As a result, the degree of freedom about the work sites of assembly and inspection can be increased, and the work efficiencies of the assembly and inspection can be improved.

Since inverter-device 601 is an electronic device, it can be properly assembled and inspected in an electronic-device factory, while compressor 501 can be properly assembled and inspected in a mechanical-device factory because it is a mechanical device. Inverter-device 601 having undergone the electronic-device factory can be conveyed to the mechanical-device factory, where compressor 501 and inverter-device 601 are electrically connected to each other with harness connector 621, and mechanically connected with bolts 556. The foregoing procedure thus can save compressor 501 a clean-room clean enough for assembling and inspecting electronic components. When the inverter-device built-in type electric compressor is inspected, compressor 501 can be detached from inverter-device 601 mechanically by unscrewing bolts 556, or can be detached from each other electrically by parting harness connector 621. During the inspection of inverter-device 601, which is powered, since inverter housing 602 is made of thick metal and connected to container 503, housing 602 can work as a heat-sink for a short time. A dummy of the counterpart is mounted or detached when necessary for assembly, inspection, periodic check, or repair.

Figure 3:
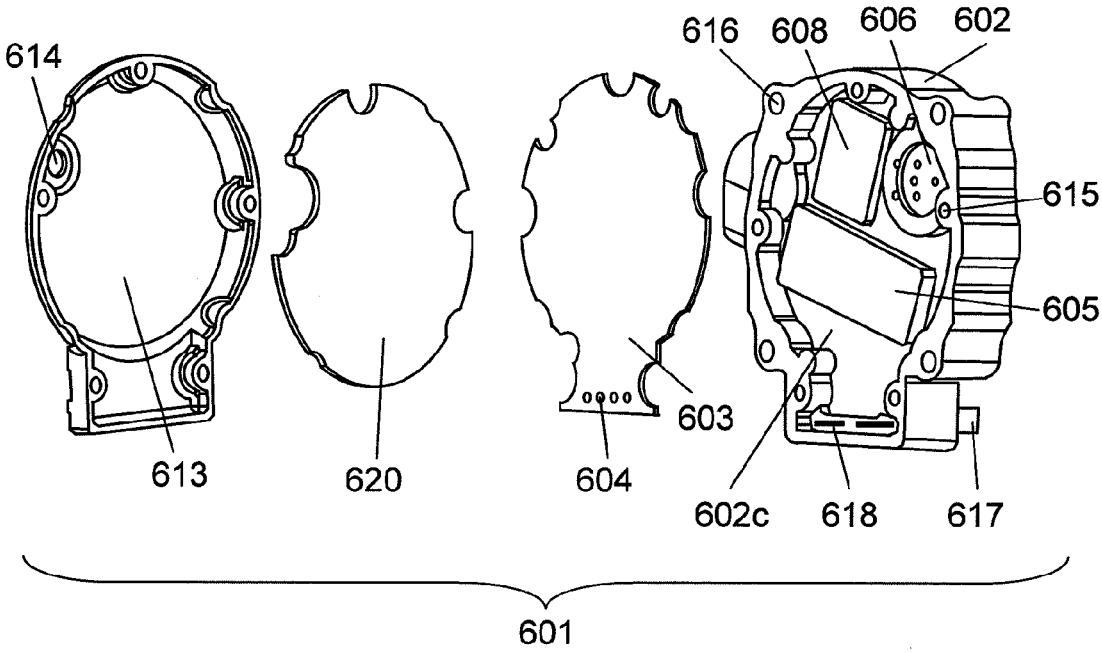
FIG. 3 shows an exploded perspective view of an inverter-device, at a switching element module side, of the inverter-device built-in type compressor in accordance with the first embodiment of the present invention.

FIG. 3 shows an exploded perspective view of inverter device 601 in accordance with the first embodiment, and device 601 is viewed from switching element module 605 side. Switching element module 605 and current smoothing capacitor 608 are placed on end wall 602*c* of inverter housing 602. Circuit board 603 covers those components including compressor terminal 606, thereby forming inverter-device 601. Terminal 618 of direct-mounting connector 617 is placed in parallel with the center axis of compressor 501, so that terminal 618 can be directly soldered to terminal-mounting hole 604 of circuit board 603 placed vertically with respect to the center axis of compressor 501. In other words, terminal 618 of connector 617 can be directly connected to circuit board 603 instead of directly connecting connector 617 to an end of inverter housing 602, or both of the connections can be implemented.

Inverter cover 613 is screwed down to inverter housing 602 with screws 555 (refer to FIGS. 1A and 1B), which extend through screw-holes 614 and are mated with screw-holes 615 of inverter housing 602. Sheet member 620 is bonded to inverter cover 613 for sound insulation and vibration damping. This structure prevents noise generated by motor 505 or compressing mechanism 504 from radiating outside. Sheet-like resin can be used instead of sheet member 620. Use of electric-insulating material as sheet member 620 ensures electrical insulation.

The comparison between FIGS. 1A and 1B, FIG. 2 and FIG. 3 reveals that positional relations, e.g. between suction port 508 and compressor terminal 606, differ from the actual ones for the purpose of description, and this difference does not affect the operation and the advantage of the inverter-device built-in type electric compressor. In this first embodiment, direct-mounting connector 617 is placed horizontally; however, it can face somewhat upward or downward so long as the work efficiency of joining/parting the connectors is not lowered and foreign matter does not enter connector 617 from the top.

Inverter-device 601 can be cooled by forming a path between inverter housing 602 and compressing mechanism 504 for the sucked refrigerant to run through as discussed above, or by exchanging the location of compressing mechanism 504 for the location of motor 505 in order to form a low-pressure type compressor. Compressing mechanism 504 can use either a scroll method or a rotary method. Inverter housing 602 is rigidly mounted to container 503 in a detachable manner with bolts as discussed above, or inverter housing 602 (male screw) can be screwed down to container 503 (female screw), or the like method can be used. The center axis of compressor 501 refers to a direction along the rotary shaft in the case of using a rotary compressor, and a reciprocal direction in the case of using a linear compressor.

An insulating member such as a stainless-steel plate shaped like the mating section, where inverter housing 602 mates with container 503, is inserted between housing 602 and container 503. This structure suppresses heat conduction from container 503 to housing 602, so that the cooling effect by the refrigerant to the inverter device can be improved. The inverter-device built-in type electric compressor in accordance with this first embodiment is formed by assembling inverter device 601 to compressor 501, and they are not completely separated, so that the assembly forms the path for the refrigerant to run through, whereby the cooling function to inverter device 601 can be achieved. This structure does not need the path to be formed independently, and allows the inverter-device built-in type electric compressor to be downsized and made light-weight.

In other words, the inverter-device built-in type compressor of the present invention is formed of electric compressor 501 and inverter device 601. Compressor 501 includes compressing mechanism 504 and motor 505 for driving compressing mechanism 504. Inverter device 601 is mounted to compressor 501 along the center axis of compressor 501 and operates motor 505.

Inverter device 601 is equipped with compressor terminal 606, which electrically connects inverter device 601 to motor 505, and direct-mounting connector 617, which electrically connects inverter device 601 to an external circuit. The connecting sections of terminal 606 and connector 617 both face toward compressor 501. Connector 601 in particular is placed in parallel with the center axis of compressor 501 while it faces toward compressor 501. Harness connector 621 wired from motor 505 is electrically connected to compressor terminal 606 in a detachable manner, and compressor 501 and inverter device 601 are mechanically connected to each other in a detachable manner.

The foregoing structure allows direct-mounting connector 617, which electrically connects inverter device 601 to an external circuit, to face toward compressor 501, so that the length along the center axis can be reduced. The connecting sections of compressor terminal 606 and connector 617 of inverter device 601 both face toward compressor 501, namely, both of the connecting sections are placed on the same side, so that the work efficiencies of assembly and inspection can be improved.

Compressor 501 and inverter device 601 can be detachable electrically and mechanically, in other words, inverter device 601 can be separated from compressor 501, so that the degree of freedom about the work sites for assembly and inspection can be increased, and the work efficiencies of the assembly and inspection can be improved.

The present invention refers to the inverter-device built-in type electric compressor lying on its side, i.e. compressor 501 and inverter device 601 are placed horizontally. Since the inverter-device built-in type electric compressor lies on its side (horizontal type), the foregoing structure allows connector 617 to lie in parallel with the center axis of compressor 501, i.e. connector 617 lies horizontally. As a result, foreign matter, such as dust and moisture, can be prevented from entering connector 617 from the top when connector 617 is joined or parted to/from the counterpart. As a result, the reliability of electrical connection can be improved.

Terminals 618 of direct-mounting connector 617 lie in parallel with terminals 609 of compressor terminal 606, so that the electrical connection in assembling and inspecting inverter device 601 can be done promptly with ease with the better work efficiencies because terminals 618 and terminals 609 are directed along the same direction. When an automatic inspection device is used in particular, the electrical connection to direct-mounting connector 617 or to compressor terminal 606 can be done along one direction only, so that the jigs for electrical connection can be simplified.

The center axis of connector 617 is placed lower than the center axis of compressor 501. This structure allows a greater portion of connector 617 to be placed within a lower part of compressor 501, so that foreign matter can be prevented from attaching to connector 617 from the top. On top of that, this structure allows the width of the inverter-device built-in type electric compressor to be reduced, so that the built-in type electric compressor can be downsized and advantageously mounted with ease to an air-conditioner.

Direct-mounting connector 617 is directly mounted to circuit board 603 of inverter device 601. This structure allows terminals 618 of connector 617 to be soldered directly to terminal-mounting holes 604 of circuit board 603 placed vertically with respect to the center axis of compressor 501. The work efficiency of the soldering connection can thus be improved.

Exemplary Embodiment 2

Figure 4A:
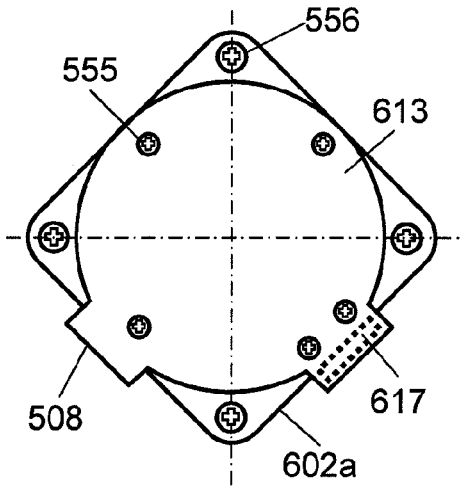
FIG. 4A shows a lateral view of an inverter-device built-in type electric compressor in accordance with a second embodiment of the present invention.
Figure 4B:
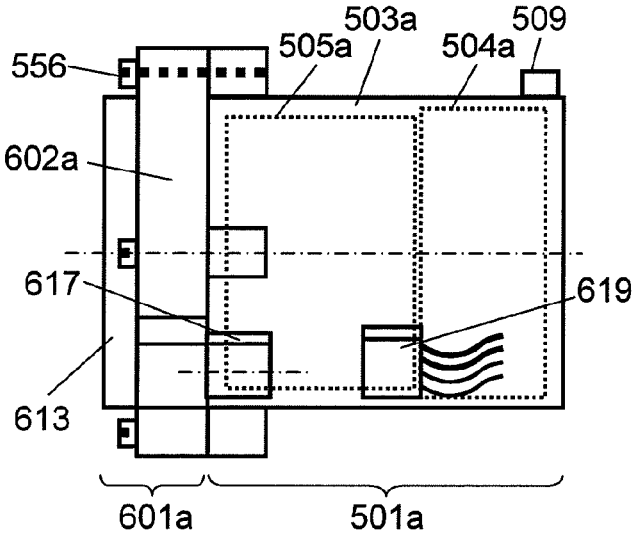
FIG. 4B shows a front view of the inverter-device built-in type electric compressor in accordance with the second embodiment of the present invention.
Figure 5:
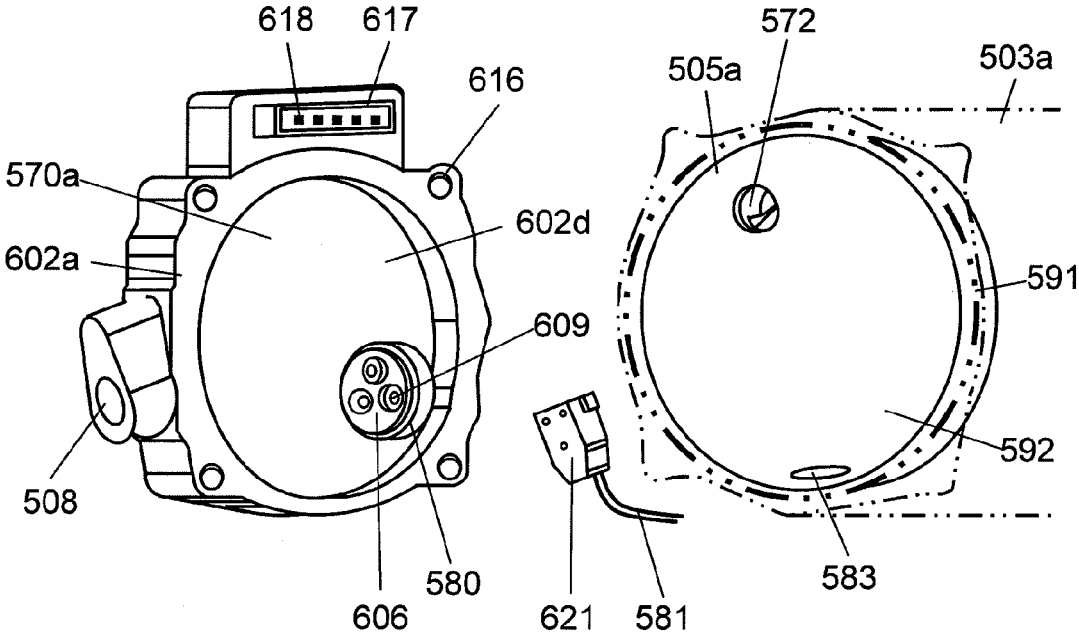
FIG. 5 shows an exploded perspective view of a space of a cooling path of the inverter-device in accordance with the second embodiment of the present invention.

A method for cooling inverter device 601 is not limited to a method of forming a path between inverter housing 602 and compressing mechanism 504 for the refrigerant to run through, but a method for forming a low-pressure type compressor by exchanging the location of compressing mechanism 504 for the location of motor 505 will do. This method is demonstrated hereinafter with reference to FIGS. 4A, 4B and 5. FIG. 4A shows a lateral view of an inverter-device built-in type electric compressor in accordance with the second embodiment, and FIG. 4B shows a front view of the inverter-device built-in type electric compressor in accordance with the second embodiment. FIG. 5 shows an exploded perspective view of cooling-path space 570*a* of inverter-device 601*a* in accordance with the second embodiment.

A comparison of FIGS. 4A and 4B with FIGS. 1A and 1B reveals the fact that the locations of motor 505*a* and compressing mechanism 504*a* in FIGS. 4A and 4B are switched relative to the locations in FIGS. 1A and 1B, and they form compressor 501*a*. Motor 505*a* is driven by inverter device 601*a*. Compressing mechanism 504*a* driven by motor 505*a* sucks the low-pressured refrigerant from a refrigerating cycle via suction port 508 placed at inverter housing 602*a* and via motor 505*a*. Compressing mechanism 504*a* then compresses the refrigerant, and then discharges the refrigerant to the refrigerating cycle from discharge port 509 provided to container 503*a*, while motor 505*a* has been cooled by the sucked refrigerant.

In FIG. 5, where cooling-path space 570*a* is illustrated, inverter housing 602*a* is mechanically connected to container 503*a* in an air-tight manner by bolts 556 extending through bolt-through holes 616 with O-ring 591 sandwiched between housing 602*a* and container 503*a*. This structure allows forming a suction path communicating with suction port 508. The refrigerant sucked from port 508 provided to inverter housing 602 diffuses in space 570*a* and cools end wall 602*d*, whereby heating members mounted behind wall 602*d* such as switching-element module 605 can be cooled. The refrigerant then flows into motor 505*a* via path hole 572 provided at motor 505*a* side.

Lead wire 581 wired from motor 505*a* connects with harness connector 621 through communicating path 583 provided around motor 505*a*, and then electrically connects with compressor terminal 606. Other structures, operations, and advantages of the inverter-device built-in type electric compressor in accordance with the second embodiment are similar to those of the first embodiment. The atmosphere around motor 505*a* is at a low pressure only, so that inverter housing 602 needs no partition for separating a high pressure from a low pressure, and no O-ring 592 for the same purpose is provided. Inverter housing 602 can be used instead of inverter housing 602*a*. To be more specific, inverter housing 602 can be used both for low-pressure type compressor 501*a* and high-pressure type compressor 501. The shapes of path hole 572 and communicating path 583 are only examples, and hole 572 and path 583 are not limited to these shapes, but they can communicate with each other, i.e. an open type can be used.

Exemplary Embodiment 3

Figure 6:
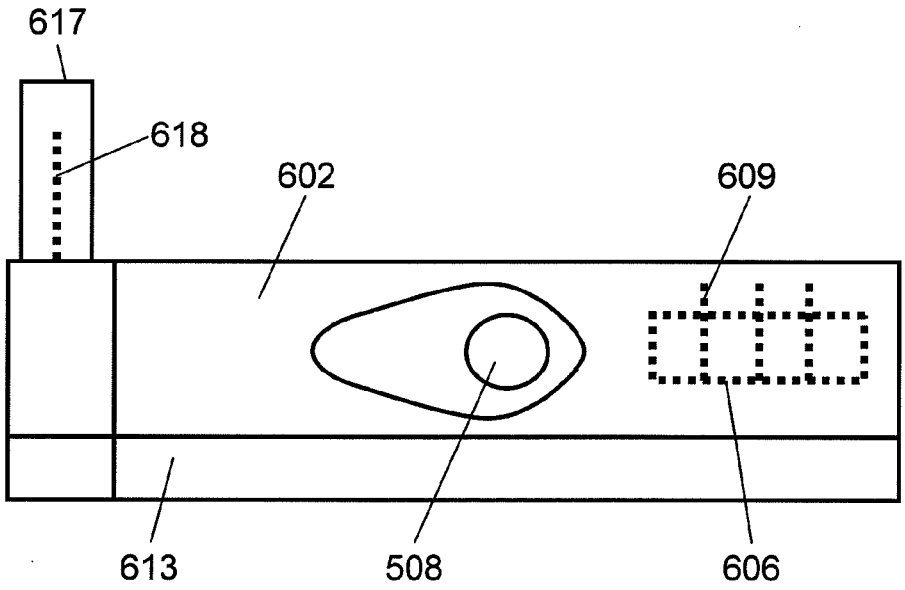
FIG. 6 shows an example of a placement of the inverter-device during an assembly step or an inspection step in accordance with a third embodiment of the present invention.

FIG. 6 shows an example of a placement of inverter device 601 in the steps of assembly and inspection in accordance with the third embodiment of the present invention. As shown in FIG. 6, terminals 618 of direct-mounting connector 617 and terminals 609 of compressor terminal 606 lie along the same direction, i.e. both of the terminals face upward in parallel with each other. The electrical connection in the step of assembly and inspection can be done quickly, thereby improving the work efficiency. When an automatic inspection device is used in particular, the electrical connection to direct-mounting connector 617 or to compressor terminal 606 can be done along one direction only, so that the jigs for electrical connection can be simplified. In order to simply mount inverter device 601 to the inspection device, the surface of inverter cover 613 is preferably flat because if cover 613 has some curvature, the directions of the terminals become unstable. The heads of screws 555 preferably do not stick out from the surface of cover 613.

Direct-mounting connector 617 and compressor terminal 606 are applied with a high voltage respectively, and they work as an input section and an output section respectively, so that a large amount of current runs through them. It is thus preferable to place connector 617 near to terminal 606 so that the route, where the large amount of current with a high voltage runs through, can be as short as possible. This structure allows not only recution of heat and electromagnetic interference but also allows for an increase in work efficiency. Inverter device 601*a* can also be structured in the same way as discussed above.

To be more specific, in the inverter-device built-in type compressor of the present invention, direct-mounting connector 617 is placed near to compressor terminal 606. This placement allows the route between connector 617, working as the input section, and terminal 606, working as the output section, to be shortened. Because a large amount of current with a high voltage runs through the input section and the output section, the heat amount and the electromagnetic interference decrease with the shorter route between them. Placement of connector 617 near to terminal 606, e.g. they are placed adjacent to each other, allows the electrical connection during the assembly and the inspection of the inverter device to be done easily and promptly, so that the work efficiency can be improved.

A flat surface of inverter cover 613 of inverter device 601 allows inverter device 601 to be placed steadily during the assembly and the inspection, so that the workability can be improved.

Exemplary Embodiment 4

Figure 7:
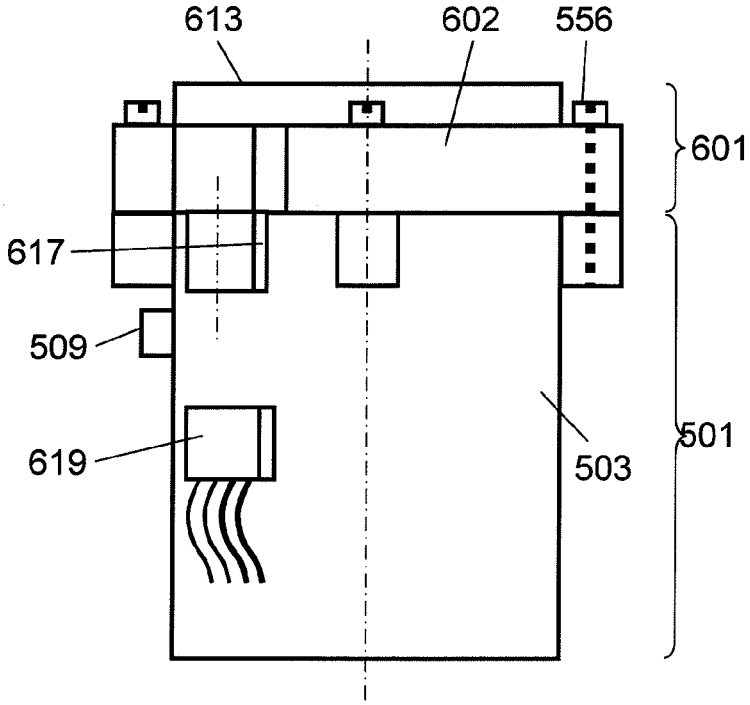
FIG. 7 shows a vertical inverter-device built-in type electric compressor in accordance with a fourth embodiment of the present invention.

FIG. 7 shows a vertical inverter-device built-in type electric compressor in accordance with the fourth embodiment of the present invention. In the first and second exemplary embodiments, the horizontal type inverter-device built-in electric compressors, which lie on their sides, are discussed However, the vertical type built-in electric compressor, in which inverter-device 601 is placed at upside, will do. In this case, since the structure of inverter device 601 is kept the same, the operation and the advantage involved in the assembly and the inspection related to inverter device 601 can also be kept the same as discussed previously. Direct-mounting connector 617, in this case, face downward, so that foreign matter can be positively prevented from entering connector 617 when connector 619 is joined to or parted from connector 617. Connector 617 is placed at the upper side of the vertical type inverter-device built-in electric compressor, so that a space for connecting/disconnecting the counterpart connector 619 can be secured. The vertical type electric compressor thus cannot lower the workability of the joining/parting operation of connector 619. In the case of placing inverter device 601*a* shown in FIG. 4 at the upper side, the same operation and advantages as discussed above can be expected for this vertical type electric compressor.

The inverter-device built-in type electric compressor in accordance with this fourth embodiment of the present invention is formed of compressor 501 and inverter device 601 placed in a vertical direction. This structure allows direct-mounting connector 617 to face downward, so that foreign matter such as moisture or dust can be positively prevented from entering connector 617 when connector 617 is joined to or parted from the counterpart.

Exemplary Embodiment 5

Figure 8:
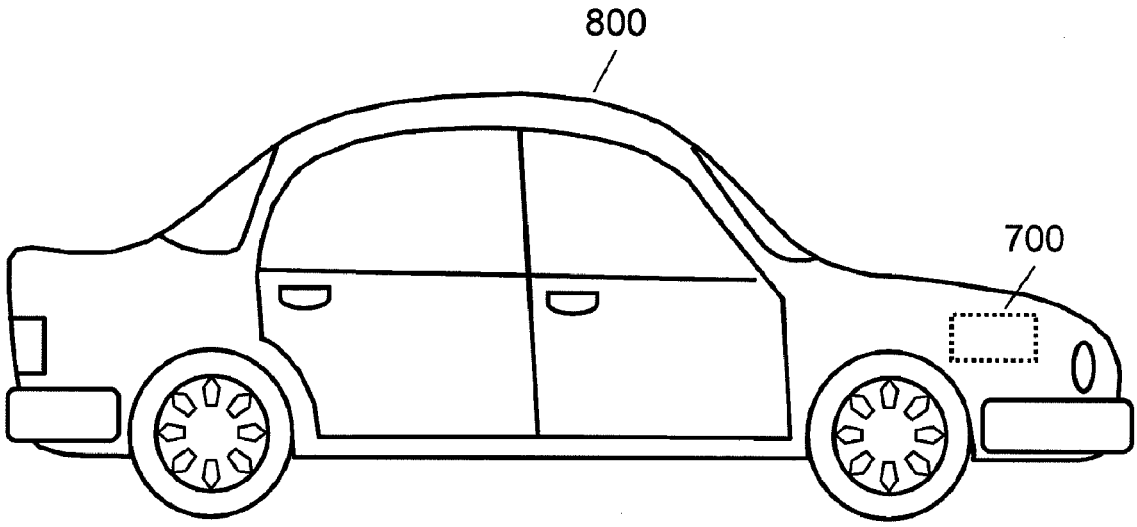
FIG. 8 shows a vehicle equipped with the inverter-device built-in type electric compressor of the present invention.

FIG. 8 shows vehicle 800 equipped with inverter-device built-in type electric compressor 700 in accordance with the fifth embodiment of the present invention. Compressor 700 is used together with, e.g. an indoor unit (not shown) of an air-conditioner which supplies cooled air into the interior of vehicle 800.

A variety of components, devices, and equipment should be mounted in vehicle 800 within a limited space, so that each one of the components, devices and equipment needs to be downsized and made light-weight. Inverter-device built-in electric compressor 700 discussed in embodiments 1-4 should be placed at some place in the vehicle and connected to the indoor unit of the air-conditioner. The length along the center axis of compressor 700 can be advantageously shortened, so that compressor 700 can be downsized along the center axis. Compressor 700 is useful because it has a greater degree of freedom for placement in vehicle 800. Vehicle 800 equipped with compressor 700 can thus be downsized and made light-weight.

The inverter-device built-in type electric compressor of the present invention can advantageously reduce the length along the center axis, so that the compressor can be downsized. On top of that, the work efficiency during the assembly and the inspection can be increased, and the reliability of the inverter device can be increased. The inverter-device built-in type electric compressor of the present invention is useful because it can be widely used such as in household and industrial applications.

The invention claimed is:

1. An inverter device built-in type electric compressor assembly comprising:

a container accommodating therein an electric compressor having a compressor mechanism and a motor for driving the compressor mechanism; wherein the compressor mechanism and the motor are completely housed within the container;

an inverter housing accommodating therein an inverter device, the inverter device being configured to operate the motor of the electric compressor; wherein the inverter housing is mounted to a longitudinal end of said container along a center axis of the electric compressor, the inverter housing having a compressor-side face coupled directly to the container; and wherein the container is detachably and mechanically connected to the inverter housing;

a compressor terminal provided to the inverter housing on the compressor-side face for electrically connecting the inverter device to the electric compressor; wherein a harness connector from the motor is detachably and electrically connected to the compressor terminal;

and a direct-mounting connector mounted to the inverter housing at an outer periphery thereof and provided on the compressor-side face for electrically connecting the inverter device to an external circuit connector;

wherein the direct-mounting connector extends from the compressor-side face toward the electric compressor and is placed in parallel with the center axis of the electric compressor; and wherein the inverter device includes a circuit board, and the direct-mounting connector is directly fixed onto the circuit board of the inverter device.

2. The inverter device built-in type electric compressor assembly of claim 1, wherein a terminal of the direct-mounting connector lies in parallel with a terminal of the compressor terminal.

3. The inverter device built-in type electric compressor assembly of claim 1, wherein the inverter device built-in type electric compressor assembly is a horizontal type compressor assembly, in which the electric compressor and the inverter device are placed along a horizontal direction.

4. The inverter device built-in type electric compressor assembly of claim 3, wherein a center axis of the direct-mounting connector is placed lower than the center axis of the electric compressor.

5. A vehicle comprising:

an inverter device built-in type electric compressor assembly comprising:

a container accommodating therein an electric compressor having a compressor mechanism and a motor for driving the compressor mechanism; wherein the compressor mechanism and the motor are completely housed within the container;

an inverter housing accommodating therein an inverter device, the inverter device being configured to operate the motor of the electric compressor; wherein the inverter housing is mounted to a longitudinal end of said container along a center axis of the electric compressor, the inverter housing having a compressor-side face coupled directly to the container; and wherein the container is detachably and mechanically connected to the inverter housing;

a compressor terminal provided to the inverter housing on the compressor-side face for electrically connecting the inverter device to the electric compressor; wherein a harness connector from the motor is detachably and electrically connected to the compressor terminal;

and a direct-mounting connector mounted to the inverter housing at an outer periphery thereof and provided on the compressor-side face for electrically connecting the inverter device to an external circuit connector;

wherein the direct-mounting connector extends from the compressor-side face toward the electric compressor and is placed in parallel with the center axis of the electric compressor; and wherein the inverter device includes a circuit board, and the direct-mounting connector is directly fixed onto the circuit board of the inverter device.

* * * * *